US010603547B2

(12) United States Patent
Hsu

(10) Patent No.: US 10,603,547 B2
(45) Date of Patent: Mar. 31, 2020

(54) SPORT TRAINING STRUCTURE

(71) Applicant: Chi-Kun Hsu, Lukang Township, Changhua County (TW)

(72) Inventor: Chi-Kun Hsu, Lukang Township, Changhua County (TW)

( * ) Notice: Subject to any disclaimer, the term of this patent is extended or adjusted under 35 U.S.C. 154(b) by 215 days.

(21) Appl. No.: 15/834,126

(22) Filed: Dec. 7, 2017

(65) Prior Publication Data

US 2019/0175990 A1 Jun. 13, 2019

(51) Int. Cl.

| | |
|---|---|
| ***G09B 19/00*** | (2006.01) |
| ***A63B 26/00*** | (2006.01) |
| ***A63K 3/04*** | (2006.01) |
| ***A47B 3/06*** | (2006.01) |
| *A47B 85/06* | (2006.01) |
| *A47C 13/00* | (2006.01) |

(52) U.S. Cl.

CPC ..... *A63B 26/00* (2013.01); *A47B 3/06* (2013.01); *A63K 3/043* (2013.01); *A47B 85/06* (2013.01); *A47C 13/00* (2013.01); *A63B 2209/00* (2013.01); *A63B 2210/50* (2013.01); *A63B 2225/09* (2013.01)

(58) Field of Classification Search

USPC ..... 434/247, 255; 446/108, 109, 111, 112, 446/115; 473/414, 438, 440; 482/14, 15, 482/51

See application file for complete search history.

(56) References Cited

U.S. PATENT DOCUMENTS

RE25,474 E * 11/1963 O'Rear ..... A63C 19/06 473/414
3,115,340 A * 12/1963 Stasiuk ..... A63B 5/22 473/414
3,226,118 A * 12/1965 Nehl ..... A63B 71/00 473/414
3,515,385 A * 6/1970 Gunderson ..... A63B 5/22 473/414
4,063,585 A * 12/1977 Stanley ..... A47G 5/00 160/135
4,134,586 A * 1/1979 King ..... A63B 23/0464 473/440
5,575,701 A * 11/1996 Hantman ..... A63H 33/10 446/104
5,630,587 A * 5/1997 Zlotsky ..... A63F 9/088 273/155
6,053,824 A * 4/2000 Boudreaux ..... A63B 9/00 473/440
6,176,757 B1 * 1/2001 Lin ..... A63H 33/101 446/102

(Continued)

*Primary Examiner* — Kurt Fernstrom

(74) *Attorney, Agent, or Firm* — Alan D. Kamrath; Mayer & Williams PC

(57) ABSTRACT

A sport training structure includes a plurality of brackets and a plurality of first pivot members connected with the brackets. Each of the first pivot members has two connecting portions. Two of the first pivot members are mounted between two of the brackets to construct a polygonal frame, with each of the two connecting portions of each of the first pivot members being pivotally connected with one of the two pivot ends of each of the brackets. In such a manner, the two of the brackets are pivoted about the two of the first pivot members, so that the polygonal frame is foldable.

9 Claims, 11 Drawing Sheets

(56) References Cited

U.S. PATENT DOCUMENTS

| | | | | |
|---|---|---|---|---|
| 6,565,406 | B2 * | 5/2003 | Huang | A63H 33/042 446/104 |
| 7,874,959 | B2 * | 1/2011 | Dieter | A63B 23/0464 473/414 |
| 8,257,088 | B1 * | 9/2012 | Askins | G09B 19/003 434/247 |
| 8,465,290 | B1 * | 6/2013 | Rodriguez | A63B 5/22 434/247 |
| 8,579,768 | B2 * | 11/2013 | Prstojevich | A63B 23/0464 482/14 |
| 9,039,575 | B2 * | 5/2015 | Holland | A63K 3/043 473/414 |
| 9,675,830 | B2 * | 6/2017 | Holland | A63B 69/00 |
| 10,118,062 | B2 * | 11/2018 | Barr | A63B 5/00 |
| 10,300,338 | B2 * | 5/2019 | Chen | A63B 26/003 |
| 2004/0214506 | A1 * | 10/2004 | Huang | A63H 33/04 446/85 |
| 2009/0286656 | A1 * | 11/2009 | Okamoto | A63B 19/02 482/78 |
| 2010/0298074 | A1 * | 11/2010 | Esposito | A63B 69/00 473/438 |
| 2015/0060204 | A1 * | 3/2015 | Walter | E06C 1/383 182/163 |

* cited by examiner

SPORT TRAINING STRUCTURE

BACKGROUND OF THE INVENTION

1. Field of the Invention

The present invention relates to a sport training structure.

2. Description of the Related Art

A conventional sport training structure comprises a plurality of step training loops which are arranged in series. Each of the step training loops has a ring shape or a polygonal shape. In practice, the step training loops are placed on the ground. When the athlete passes the step training loops, his/her feet have to in turn step into each of the step training loops, so as to achieve the step training effect. However, the step training loops are not fixed, so that the positions of the step training loops are easily changed due to frequent hits. Thus, the user has to rearrange the step training loops after usage during a period of time, thereby causing inconvenience to the user when using the step training loops. In addition, the step training loops have determined sizes and cannot be folded, thereby increasing the whole volume when not in use, and thereby causing inconvenience in storage and transportation of the step training loops.

BRIEF SUMMARY OF THE INVENTION

The primary objective of the present invention is to provide a sport training structure having diverse variations of assembly to construct training tools of different modes.

In accordance with the present invention, there is provided a sport training structure comprising a plurality of brackets and a plurality of first pivot members connected with the brackets. Each of the first pivot members has two connecting portions. Two of the first pivot members are mounted between two of the brackets to construct a polygonal frame, with each of the two connecting portions of each of the first pivot members being pivotally connected with one of the two pivot ends of each of the brackets. In such a manner, the two of the brackets are pivoted about the two of the first pivot members, so that the polygonal frame is foldable.

Preferably, each of the brackets is provided with at least one mounting portion.

Preferably, each of the brackets is further provided with at least one second pivot member which has two linking portions, with the at least one mounting portion of each of the brackets being pivotally connected with one of the two linking portions of the at least one second pivot member.

Preferably, multiple polygonal frames constructed by the brackets and the first pivot members are connected by multiple second pivot members.

Preferably, the multiple polygonal frames constructed by the brackets and the first pivot members are pivotally connected by the multiple second pivot members, so that the multiple polygonal frames constructed by the brackets and the first pivot members are foldable.

Preferably, the at least one second pivot member is made of elastic material and is formed integrally.

Preferably, each of the brackets is made of elastic material and is formed integrally.

Preferably, each of the first pivot members is made of elastic material and is formed integrally.

Preferably, each of the first pivot members is pivotally connected with the at least one mounting portion of each of the brackets.

Preferably, the sport training structure further comprises at least one third pivot member having two fitting portions pivotally connected with the two pivot ends of each of the brackets, so that the brackets and the at least one third pivot member are combined to construct a hurdle.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
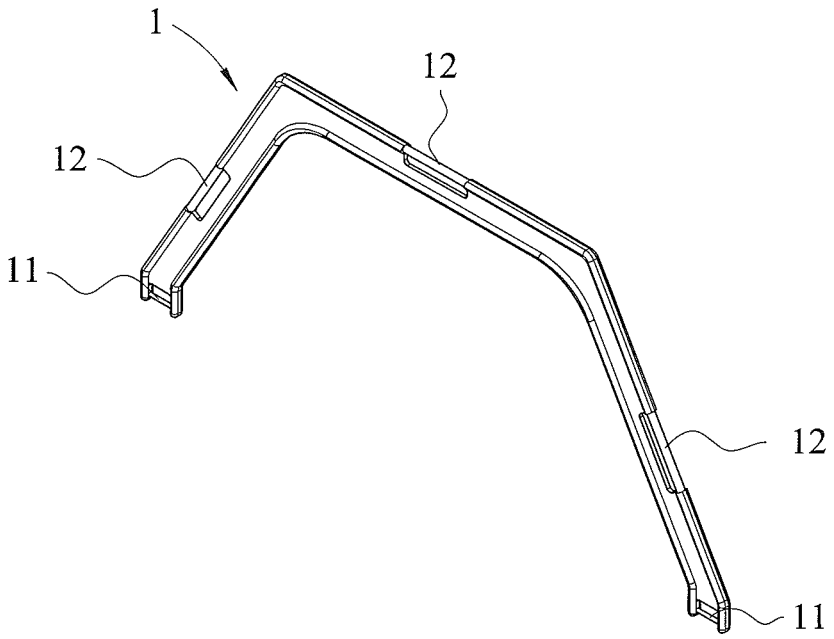
FIG. 1 is a perspective view of a bracket of a sport training structure in accordance with the preferred embodiment of the present invention.

Referring to FIGS. 1-11, a sport training structure in accordance with the preferred embodiment of the present invention comprises a plurality of brackets 1 and a plurality of first pivot members 2 connected with the brackets 1. Each of the brackets 1 has a substantially U-shaped profile and has two pivot ends 11. Each of the first pivot members 2 has two connecting portions 21. Two of the first pivot members 2 are mounted between two of the brackets 1 to construct a polygonal frame, with each of the two connecting portions 21 of each of the first pivot members 2 being pivotally connected with one of the two pivot ends 11 of each of the brackets 1. In such a manner, the two of the brackets 1 are pivoted about the two of the first pivot members 2, so that the polygonal frame is foldable.

In the preferred embodiment of the present invention, each of the brackets 1 is provided with at least one mounting portion 12.

In the preferred embodiment of the present invention, each of the brackets 1 is further provided with at least one second pivot member 3 which has two linking portions 31, with the at least one mounting portion 12 of each of the brackets 1 being pivotally connected with one of the two linking portions 31 of the at least one second pivot member 3.

In the preferred embodiment of the present invention, multiple polygonal frames constructed by the brackets 1 and the first pivot members 2 are connected by multiple second pivot members 3.

In the preferred embodiment of the present invention, the multiple polygonal frames constructed by the brackets 1 and the first pivot members 2 are pivotally connected by the multiple second pivot members 3, so that the multiple polygonal frames constructed by the brackets 1 and the first pivot members 2 are foldable.

In the preferred embodiment of the present invention, the at least one second pivot member 3 is made of elastic material and is formed integrally.

In the preferred embodiment of the present invention, each of the brackets 1 is made of elastic material and is formed integrally.

In the preferred embodiment of the present invention, each of the first pivot members 2 is made of elastic material and is formed integrally. In the preferred embodiment of the present invention, each of the first pivot members 2 is pivotally connected with the at least one mounting portion 12 of each of the brackets 1, with the at least one mounting portion 12 of each of the brackets 1 being pivotally connected with each of the two connecting portions 21 of each of the first pivot members 2.

In the preferred embodiment of the present invention, the sport training structure further comprises at least one third pivot member 4 having two fitting portions 41 pivotally connected with the two pivot ends 11 of each of the brackets 1, so that the brackets 1 and the at least one third pivot member 4 are combined to construct a hurdle.

Figure 2:
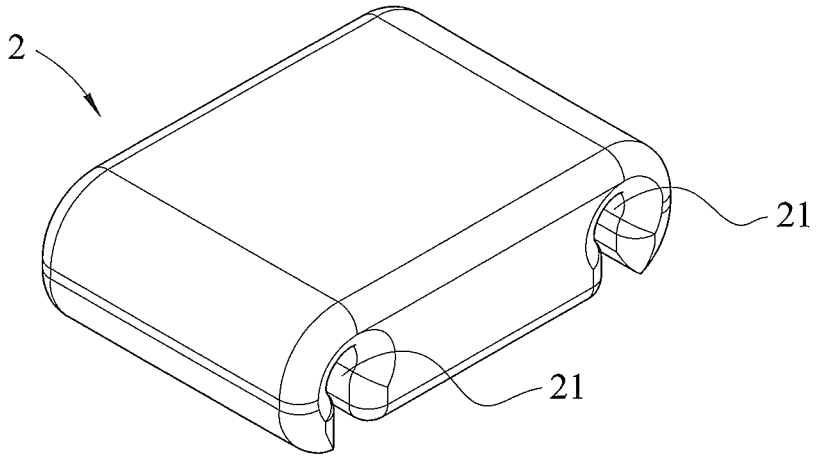
FIG. 2 is a perspective view of a first pivot member of the sport training structure in accordance with the preferred embodiment of the present invention.
Figure 3:
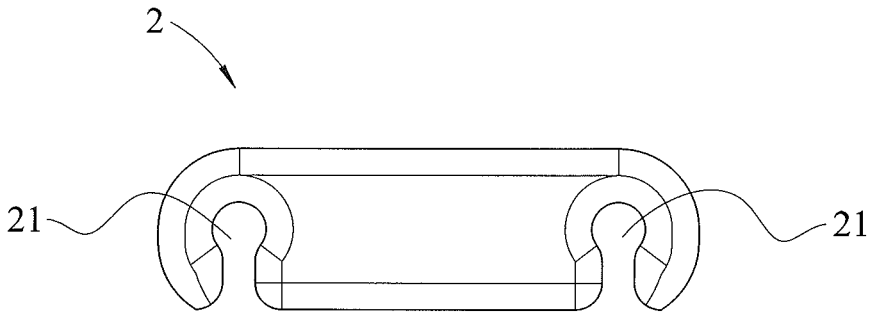
FIG. 3 is a side view of the first pivot member as shown in FIG. 2.

In assembly, referring to FIGS. 4-11 with reference to FIGS. 1-3, the brackets 1, the first pivot members 2, the at least one second pivot member 3 and the at least one third pivot member 4 are assembled to present different practice modes.

Figure 4:
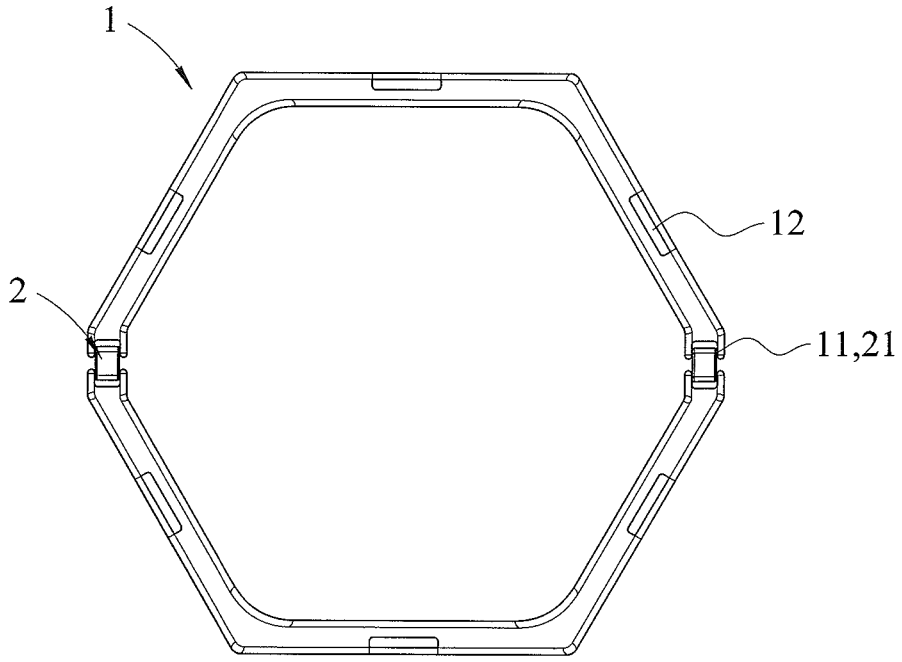
FIG. 4 is a schematic view showing combination of two brackets and two first pivot members.
Figure 5:
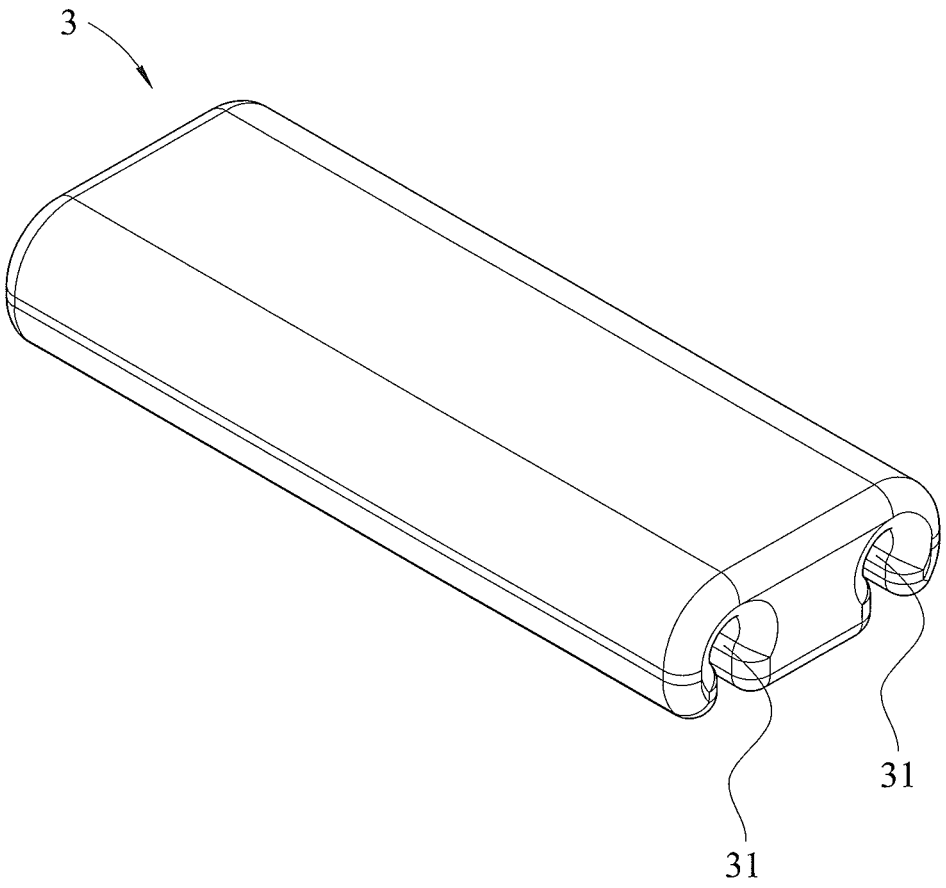
FIG. 5 is a perspective view of a second pivot member of the sport training structure in accordance with the preferred embodiment of the present invention.
Figure 6:
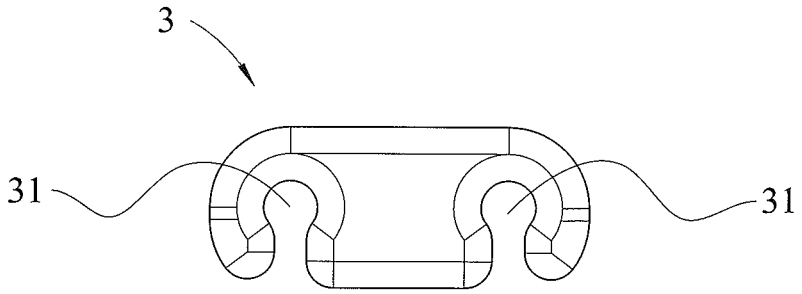
FIG. 6 is a side view of the second pivot member as shown in FIG. 5.

As shown in FIG. 4, a first mode is shown. In the first mode, two brackets 1 are juxtaposed to each other, and two first pivot members 2 are mounted between the two brackets 1 to construct a polygonal frame, with each of the two connecting portions 21 of each of the first pivot members 2 being pivotally connected with one of the two pivot ends 11 of each of the brackets 1. In such a manner, the two pivot ends 11 of each of the brackets 1 are pivoted about the two of the first pivot members 2, so that the two brackets 1 are pivotally connected by the two first pivot members 2.

Figure 7:
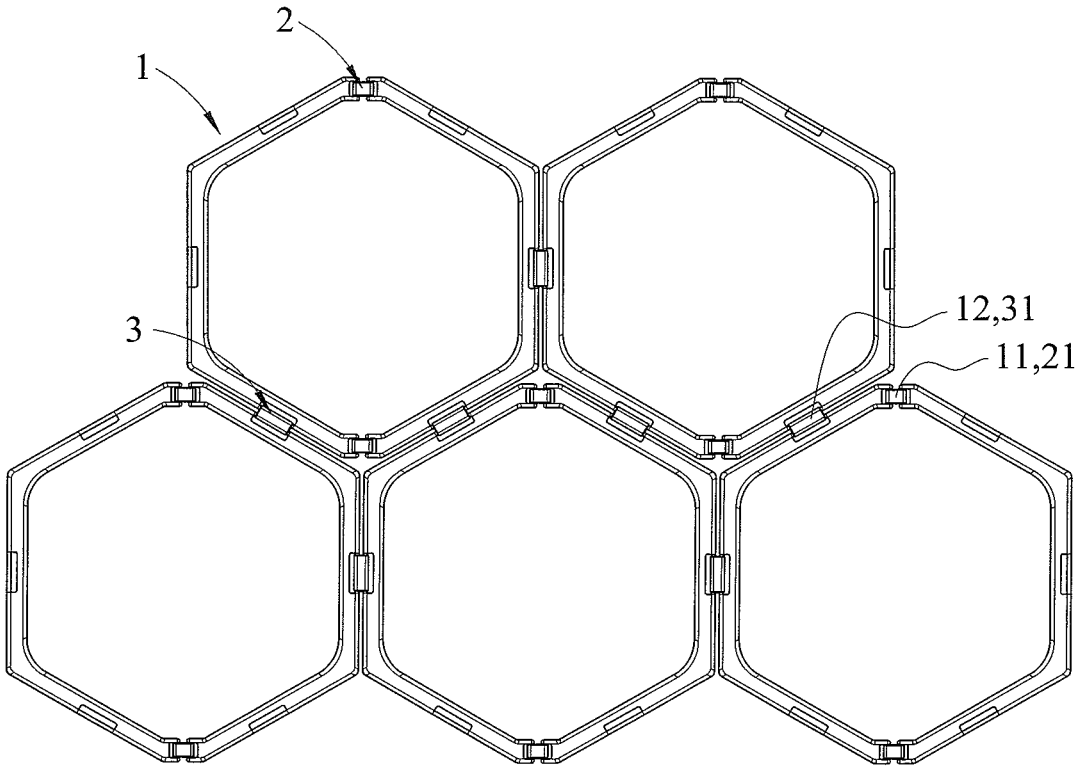
FIG. 7 is a schematic view showing combination of multiple polygonal frames.

As shown in FIG. 7, a second mode is shown. In the second mode, multiple polygonal frames constructed by the brackets 1 and the first pivot members 2 are juxtaposed to each other, and multiple second pivot members 3 are mounted between the multiple polygonal frames. In such a manner, the at least one mounting portion 12 of each of the brackets 1 is pivotally connected with one of the two linking portions 31 of each of the second pivot members 3, so that the multiple polygonal frames constructed by the brackets 1 and the first pivot members 2 are pivotally connected by the multiple second pivot members 3. Thus, the multiple polygonal frames constructed by the brackets 1 and the first pivot members 2 are placed on the ground to function as training loops so as to facilitate the user practicing steps.

Figure 8:
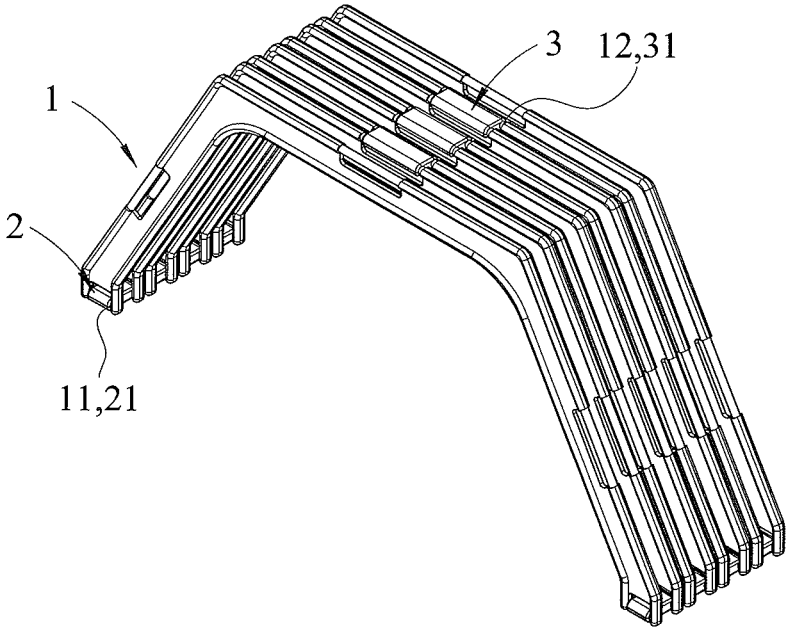
FIG. 8 is a perspective view showing stacking of multiple brackets.
Figure 9:
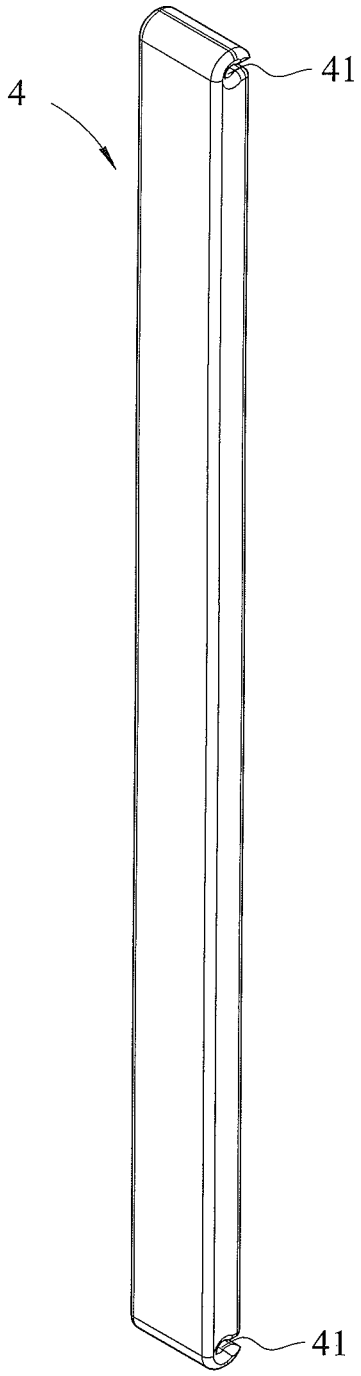
FIG. 9 is a perspective view of a third pivot member of the sport training structure in accordance with the preferred embodiment of the present invention.
Figure 10:
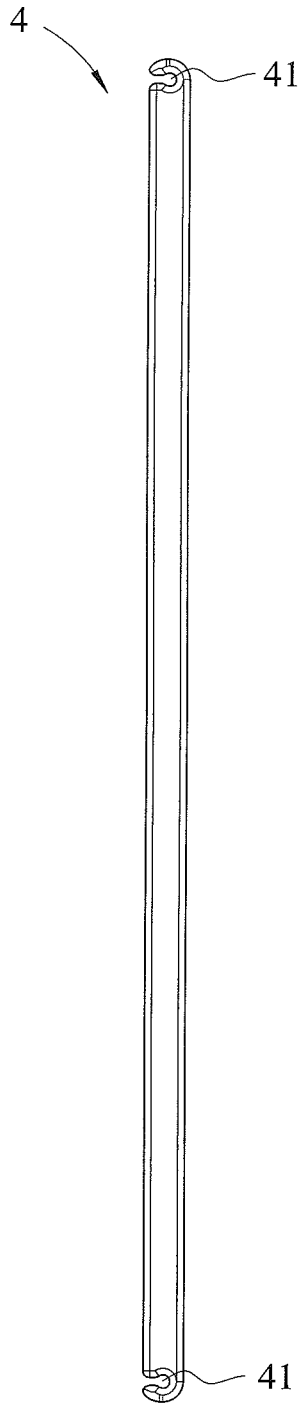
FIG. 10 is a side view of the third pivot member as shown in FIG. 9.

As shown in FIG. 8, a third mode is shown. In the third mode, the brackets 1 are stacked together and overlap each other. At this time, the two connecting portions 21 of each of the first pivot members 2 are pivotally connected with the two pivot ends 11 of each of the brackets 1, and the two linking portions 31 of the second pivot members 3 are pivotally connected with the mounting portions 12 of the brackets 1, so that the brackets 1 are secured by the first pivot members 2 and the second pivot members 3. Thus, the brackets 1 are folded to reduce the volume of the sport training structure. In such a manner, the brackets 1 are combined to function as a chair. Alternatively, a board is placed on the brackets 1 to function as a table.

Figure 11:
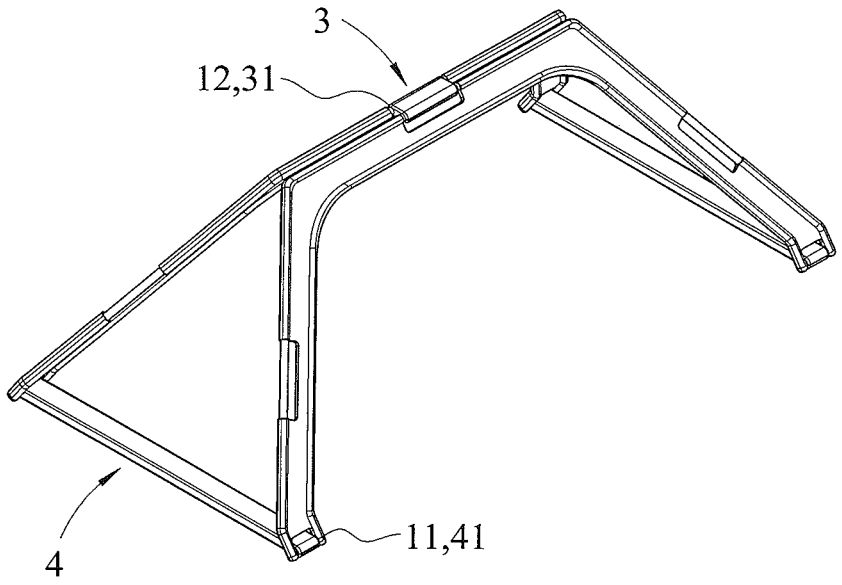
FIG. 11 is a perspective view showing combination of two brackets and two third pivot members.

As shown in FIG. 11, a fourth mode is shown. In the fourth mode, upper ends of two brackets 1 are juxtaposed to each other, the at least one second pivot member 3 is mounted on the upper ends of the two brackets 1, and two third pivot members 4 are mounted between lower ends of the two brackets 1. At this time, the at least one mounting portion 12 of each of the brackets 1 is pivotally connected with one of the two linking portions 31 of the at least one second pivot member 3, and the two fitting portions 41 of each of the third pivot members 4 are pivotally connected with the two pivot ends 11 of each of the brackets 1, so that the brackets 1, the at least one second pivot member 3 and the at least one third pivot member 4 are combined to construct a hurdle.

Accordingly, the brackets 1 cooperate with the first pivot members 2, the at least one second pivot member 3 and the at least one third pivot member 4 to construct training tools of different arrangements according to the user's requirement, thereby facilitating the user operating the training tools to achieve different training effects. In addition, the brackets 1 are combined together to function as a chair or cooperate with a board to function as a table, thereby enhancing the versatility of the sport training structure. Further, the brackets 1 are folded when not in use, thereby reducing the volume and facilitating storage and transportation of the sport training structure.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A sport training structure comprising:

a plurality of brackets; and a plurality of first pivot members connected with the brackets;

wherein:

each of the brackets has two pivot ends;

each of the first pivot members has two connecting portions;

two of the first pivot members are mounted between two of the brackets to construct a polygonal frame, with each of the two connecting portions of each of the first pivot members being pivotally connected with one of the two pivot ends of each of the brackets; and the two of the brackets are pivoted about the two of the first pivot members, so that the polygonal frame is foldable.

2. The sport training structure of claim 1, wherein each of the brackets is provided with at least one mounting portion.

3. The sport training structure of claim 2, wherein each of the brackets is further provided with at least one second pivot member which has two linking portions, with the at least one mounting portion of each of the brackets being pivotally connected with one of the two linking portions of the at least one second pivot member.

4. The sport training structure of claim 3, wherein multiple polygonal frames constructed by the brackets and the first pivot members are connected by multiple second pivot members.

5. The sport training structure of claim 4, wherein the multiple polygonal frames constructed by the brackets and the first pivot members are pivotally connected by the multiple second pivot members, so that the multiple polygonal frames constructed by the brackets and the first pivot members are foldable.

6. The sport training structure of claim 3, wherein the at least one second pivot member is made of elastic material.

7. The sport training structure of claim 1, wherein each of the brackets is made of elastic material.

8. The sport training structure of claim 1, wherein each of the first pivot members is made of elastic material.

9. The sport training structure of claim 2, wherein each of the first pivot members is pivotally connected with the at least one mounting portion of each of the brackets.

* * * * *